US011843176B2

(12) United States Patent
Chen et al.

(10) Patent No.: US 11,843,176 B2
(45) Date of Patent: Dec. 12, 2023

(54) ARRAY ANTENNA

(71) Applicant: QuantumZ Inc., Kaohsiung (TW)

(72) Inventors: Wei-Huang Chen, Kaohsiung (TW); Meng-Hua Tsai, Kaohsiung (TW); Wei-Ting Lee, Kaohsiung (TW); Sin-Siang Wang, Kaohsiung (TW)

(73) Assignee: QUANTUMZ INC., Kaohsiung (TW)

( * ) Notice: Subject to any disclaimer, the term of this patent is extended or adjusted under 35 U.S.C. 154(b) by 59 days.

(21) Appl. No.: 17/680,312

(22) Filed: Feb. 25, 2022

(65) Prior Publication Data

US 2023/0058196 A1 Feb. 23, 2023

(30) Foreign Application Priority Data

Aug. 17, 2021 (TW) ..... 110130303

(51) Int. Cl.
*H01Q 21/06* (2006.01)
*H01Q 9/04* (2006.01)

(52) U.S. Cl.
CPC ..... *H01Q 21/065* (2013.01); *H01Q 9/045* (2013.01); *H01Q 21/064* (2013.01)

(58) Field of Classification Search
CPC ..... H01Q 21/065; H01Q 9/045; H01Q 21/064
See application file for complete search history.

(56) References Cited

U.S. PATENT DOCUMENTS 4,686,535 A * 8/1987 Lalezari ..... H01Q 21/065 343/700 MS
2010/0134376 A1* 6/2010 Margomenos ..... H01Q 21/065 343/860
2021/0072350 A1* 3/2021 Loesch ..... G01S 7/032

* cited by examiner

*Primary Examiner* — Dieu Hien T Duong
(74) *Attorney, Agent, or Firm* — Leong C. Lei

(57) ABSTRACT

An array antenna of a radar includes a liquid crystal polymer (LCP) substrate with antenna transceiver circuits embedded. A plurality of patch array antennas are disposed on the LCP substrate and connected to the antenna transceiver circuit. Each patch array antenna includes a plurality of patch antennas connected in series, and the foremost patch antenna has a concave slot on the radiating surface by each side of respective feed line. By use of a LCP substrate can ensure stable material characteristics in different environments. Compared with a single patch antenna, the gain may be improved by 6 dB by connecting four patch antennas in series. A concave slot is formed on a radiating surface of a patch antenna to optimize a feed impedance, thereby to improve a working bandwidth of the antenna to alleviate an excessively narrow bandwidth of a patch antenna.

14 Claims, 9 Drawing Sheets

ARRAY ANTENNA

CROSS-REFERENCE TO RELATED APPLICATION

This application claims the benefit of Taiwan Patent Application No. 110130303, filed on Aug. 17, 2021, which is hereby incorporated by reference for all purposes as if fully set forth herein.

BACKGROUND

Technical Field

This application relates to a radar antenna, and particularly to an array of antennas formed by combining arrayed patch antennas and a liquid crystal polymer (LCP) substrate.

Related Art

Existing 77 GHz radar in the market works on frequency bands from 76 GHz to 81 GHz, with Rogers RO4835 substrate that is often recommended by integrated circuit (IC) manufactures. An array patch antenna structure is often utilized in radar designs because of its beam forming characteristics, hence high gain and directivity of signal radiation. Such characteristics are important for a radar when determining a position of a detected object. Chip manufacturer Texas Instruments (TI) provides a reference board (AWR1642) for a 77 GHz millimeter-wave antenna that boosts directivity and beam transmission of an automotive radar. This reference board includes a substrate with antenna transmit and receiving circuits and a number of patch array antennas parallelly arranged. The reference substrate is Rogers RO4835. However, absorption rate of the Rogers RO4835 substrate reaches 0.05% and cannot sustain severe environment challenges. A stable performance cannot be maintained under different weather conditions. In addition, patch array antennas in reference board (AWR1642) are arranged in parallel that causes signal interference between signal receiving antennas and signal transmitting antennas. In contrast, liquid crystal polymer (LCP) has a good material stability at different temperatures and humidity. The present invention utilizes LCP substrate stability to provide an innovative 77 Ghz array antenna.

SUMMARY

The present invention discloses an array antenna with an improved working bandwidth to resolve the problem of an excessively narrow bandwidth of a patch antenna.

The array antenna according to the present invention including a liquid crystal polymer (LCP) substrate and a plurality of patch array antennas. The LCP substrate has antenna transceiver circuits disposed thereon. The patch array antennas are disposed on the LCP substrate and connected to the antenna transceiver circuits. Each patch array antenna includes a plurality of patch antennas connected in series, and the foremost patch antenna of each array has at least one concave slot on the radiating surface by each side of respective feed line. Other patch antennas in the same array may also have concave slots on the radiating surface, but it is not essential for each patch antenna in an array to have concave slots.

In a patch array antenna, the length of the concave slot on the radiating surface of the foremost patch antenna is calculated using a semi-empirical formula of the resonant frequency of a patch antenna. In this embodiment, the length of the concave slot of the foremost patch antenna is between 0.28 mm and 0.33 mm. The length of the concave slot may also be substantially L/3 in other embodiments, where L is the length of the patch antenna in the feed line direction.

The LCP substrate includes a first bonding region and a second bonding region. The first bonding region is configured as the antenna transmitting end of the antenna transceiver circuit, and the second bonding region is configured as the antenna receiving end of the antenna transceiver circuit.

The array antenna further includes a control unit disposed on the LCP substrate to connect to patch array antennas at the antenna transmit end and the antenna receive end. The control unit may be disposed on the front side or back side of the LCP substrate. The control unit may be connected to the array antennas through via and/or bonding wires when disposed on the back side of the LCP substrate.

Layout directions of the patch array antennas at the antenna transmitting end and the antenna receiving end are substantially perpendicular to each other. The junction of the first bonding region and the second bonding region includes at least a truncated corner for lowering a discontinuous point of a ground, where length of the truncated corner is $1.5\lambda_g$, where $\lambda_g$ is the wavelength of the corresponding frequency.

The distance between a main body of the array antenna and a grounding in a lower layer is approximately 80 μm~120 μm.

A patch array antenna comprises of patch antennas connected in series, and is connected through via on the LCP substrate.

The quantity of patch antennas comprised by a single patch array antenna is 4 in this embodiment. The center impedance of the foremost patch antenna is between 0Ω and 50Ω, and the edge impedance of the foremost patch antenna is between 298Ω and 322Ω.

The moisture absorption rate of the LCP substrate in this embodiment is 0.03%, which is lower as compared to 0.05% of Rogers RO4835 in existing market, hence the LCP substrate are more stable in different environments.

To conclude, the array antenna according to the present invention achieves a relatively high directivity and a relatively high gain. Compared with a single patch array antenna, the gain is improved by arranging a plurality of patch array antennas. A concave slot is arranged on the radiating surface of the foremost patch antenna to optimize the feed impedance, thereby improves the working bandwidth of the antenna to alleviate the problem of an excessively narrow bandwidth of a patch array antenna.

DETAILED DESCRIPTION

In order for the objectives and advantages of the present invention to be clearer, the following embodiments of the present invention are described with reference to the accompanying drawings.

Figure 1:
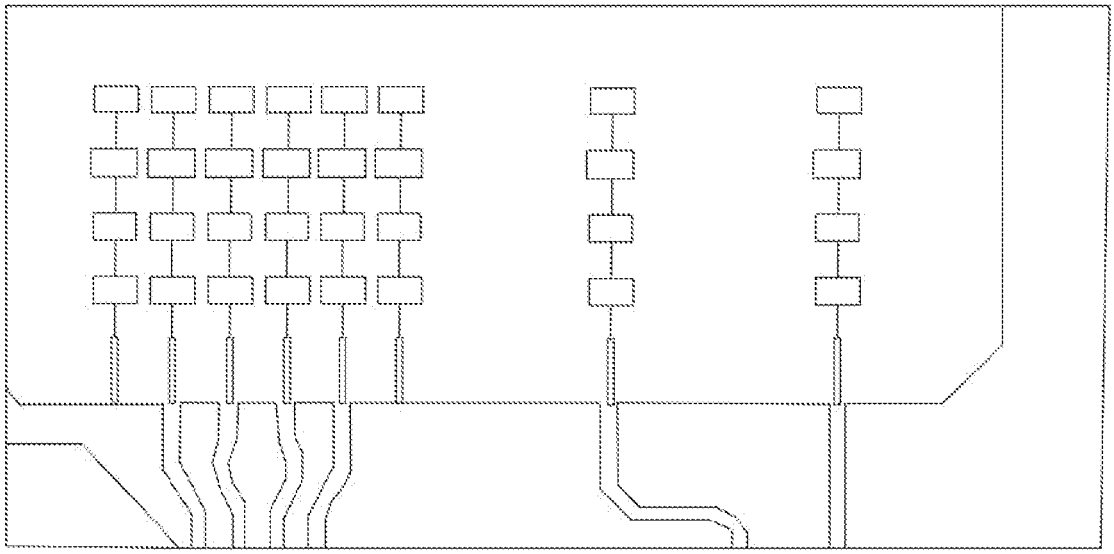
FIG. 1 is the diagram of an array antenna of a TI-AWR1642 reference board.
Figure 2:
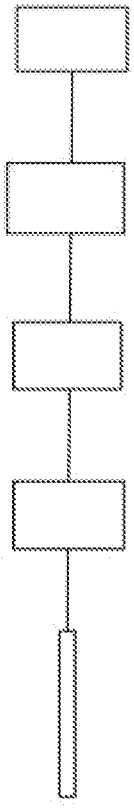
FIG. 2 is the diagram of a single patch array antenna of a TI-AWR1642 reference board.

With reference to FIG. 1 and FIG. 2, existing 77 GHz millimeter wave antenna with reference board design (AWR1642) by the chip manufacturer Texas Instruments (TI) is characterized by high directivity and beam transmission. A single patch antenna architecture of existing array antenna is shown in FIG. 2.

The reference board design shown in FIG. 1 includes a substrate with antenna transmitting and receiving circuits embedded and a plurality of patch array antennas disposed in parallel. Rogers RO4835 substrate is used for this reference board. However, environments may vary and subject to severe challenges. The moisture absorption rate of Rogers RO4835 substrate is 0.05% and considered to be the cause of unstable performance of this reference board.

In another aspect, the patch array antennas are disposed in parallel in the reference board design (AWR1642). Signal interferences are observed between the receiving antenna and the transmitting antenna.

Figure 3:
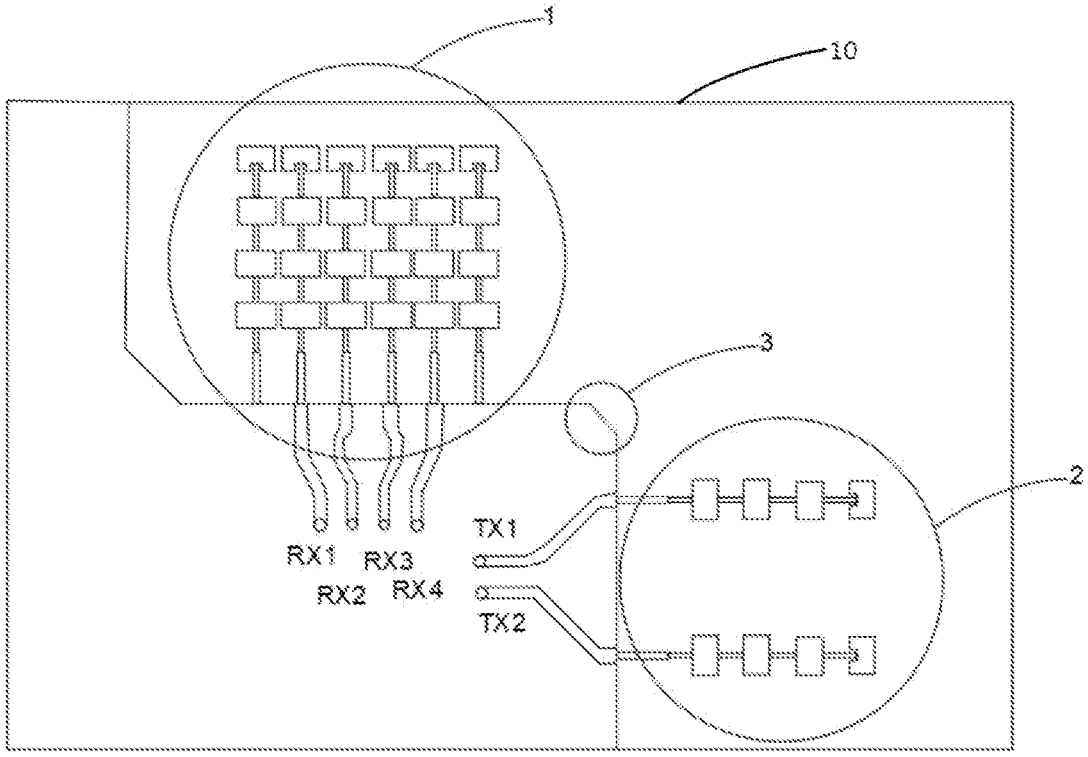
FIG. 3 is the diagram of an array antenna of an embodiment according to the present invention.
Figure 4:
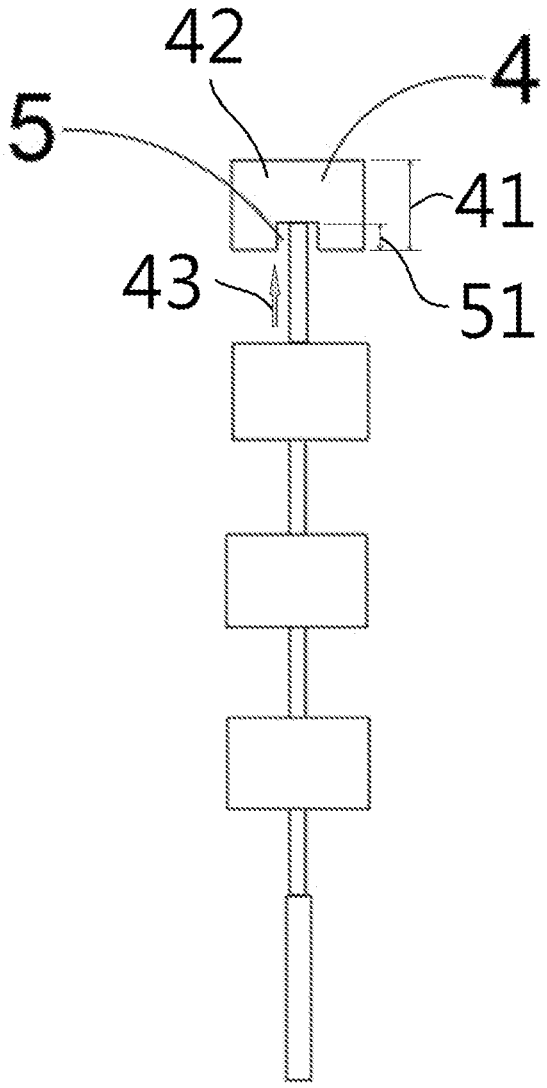
FIG. 4 is the diagram of a single patch array antenna of an embodiment according to the present invention.

With reference to FIG. 3 and FIG. 4, the present invention provides an array antenna including an LCP substrate 10, and a plurality of patch array antennas 1 and 2 disposed thereon. The LCP substrate 10 has antenna transceiver circuit embedded in the LCP substrate 10. Each patch array antenna 1 and 2 includes a plurality of patch antennas 4 connected in series. The radiating surface of the foremost patch antenna of the patch array antennas 4 has concave slots 5 opened by two sides of the feed line.

In this embodiment, the array antenna 10 is designed using a LCP substrate. The LCP material has characteristics of low loss and low moisture absorption that is important for millimeter wave antenna such as for a 77 Ghz automotive radar.

In this embodiment, layout directions of the patch array antennas in the antenna transmitting end 1 and the patch array antennas in the antenna receiving end 2 are substantially perpendicular to each other. In contrast to existing parallel arrangement, the perpendicular arrangement of the present invention effectively reduces interferences between array antennas in the antenna transmitting end and the antenna receiving end.

FIG. 4 shows a single patch array antenna and two concave slots 5 are formed in the foremost patch antenna 4. The center impedance of the foremost patch antenna is between 0Ω and 50Ω, and the edge impedance of the foremost patch antenna is between 298Ω and 322Ω. The length 51 of the concave slots 5 on the radiating surface 42 of the foremost patch antenna 4 is L/3, where L is the length 41 of the foremost patch antenna 4 in the feed line direction 43. This concave slot 5 improves impedances matching of the patch antenna, and may optimize impedance matching in an intended working frequency range to alleviate the problem of a poor bandwidth of the patch antenna.

In some embodiments, aside from concave slots 5 on the radiating surface of the foremost patch antenna 4 of the patch array antenna, concave slots 5 may also be formed on the second foremost patch antenna. The design of such concave slots 5 may further adjust impedance matching of the patch antenna. The length of the concave slots 5 may be from 0.28 mm to 0.33 mm.

In some embodiments, concave slots 5 are formed on the radiating surface of each of the second foremost patch antenna and third foremost patch antenna of patch array antennas. The design of this concave slots 5 may further adjust impedance matching to alleviate the problem of relatively poor bandwidth of the patch antenna.

In other embodiments, concave slots 5 are formed on the radiating surface of the foremost patch antenna 4 of the patch array antenna by both sides of the feed line, but only by formed by one side of the feed line on the radiating surfaces of remaining patch antennas. Such design of concave slots 5 may further adjust impedance matching to alleviate the problem of a relatively poor bandwidth of the patch antenna. The length of the concave slots constrains the frequency ratio of a dual-band patch. The first resonant frequency may be calculated by using a semi-empirical formula for a rectangular patch antenna, and the second resonant frequency may be calculated by using a transmission linear model.

In this embodiment, the center impedance of the patch antenna 4 is ideally 0Ω, and the edge impedance is 310Ω, but the center impedance of the patch antenna 4 may optionally be 50Ω. According to further experiments, a working frequency band from 76 GHz to 81 GHz is ensured when the length of the concave slots 5 of the patch antenna 4 is approximately 0.30 mm.

In this embodiment, the patch antenna 4 is a pancake-shaped directional antenna formed by superposing two metal plates (where one metal plate is larger than another metal plate), and a dielectric film layer there between.

In this embodiment, the patch antenna 4 generates a hemispherical coverage, propagates from the mounting point, and extends to a range between 30 degrees and 180 degrees.

In existing TI reference board design, the antenna transmitting end and the antenna receiving end are placed in parallel. In the array antenna according to present invention, the antenna transmitting end and the antenna receiving end are placed perpendicularly. Such perpendicular arrangement may improve isolation and shorten the length of the transmission line, and may reduce signal loss on the transmission line.

In this embodiment, the LCP substrate includes a first bonding region 1 and a second bonding region 2, where the first bonding region 1 is configured as the antenna transmitting end of the array antenna 10, and the second bonding region 2 is configured as the antenna receiving end of the array antenna 10. Layout directions of the patch array antennas at the transmitting end and the receiving end are substantially perpendicular to each other.

With reference to FIG. 3, the junction of the first bonding region and the second bonding region has a truncated corner 3, or a corner cut. This truncated corner 3 may be in the shape of rectangle, circular arc or chamfer. Such truncated corner 3 is to lower a discontinuous point of a grounding, and may improve matching effect of the array antenna 10. The length of the truncated corner 3 is $1.5\lambda_g$, where $\lambda_g$ is the wavelength of the corresponding frequency.

Figure 7:
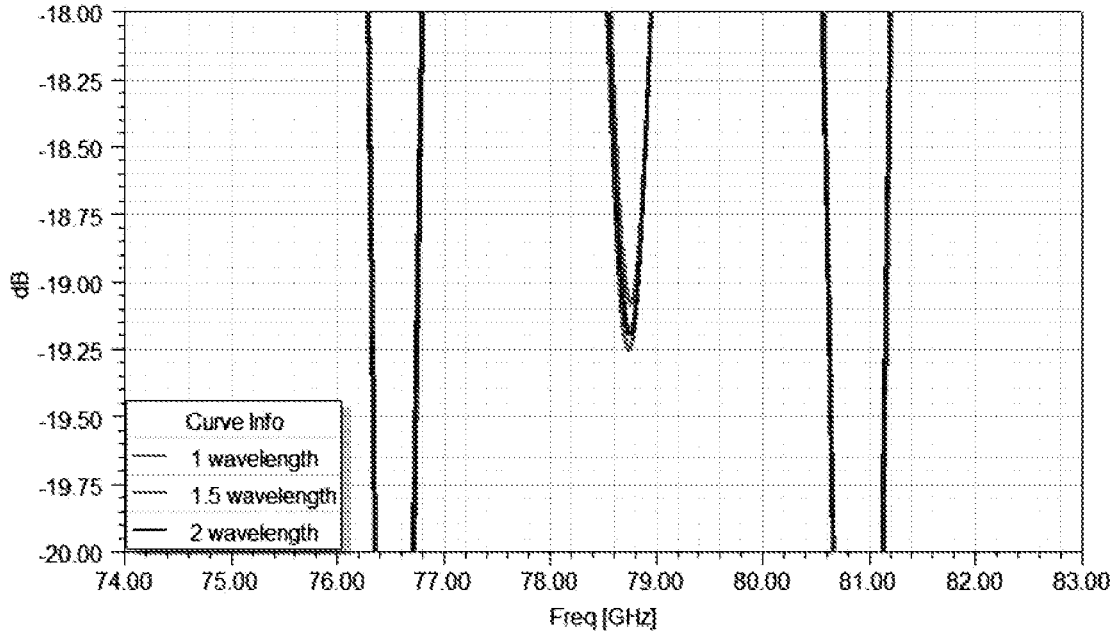
FIG. 7 is the Return Loss diagram of different lengths of the truncated corner according to the present invention.

As shown in FIG. 7, the truncated corner 3 cannot lower the discontinuous point of the grounding, and cannot improve the matching effect of the antenna when the length of the truncated corner 3 is $1.0\lambda_g$ or $2.0\lambda_g$. The truncated corner 3 effectively lowers the discontinuous point of the ground and improves the matching effect of the antenna when the length is 1.54.

Figure 5:
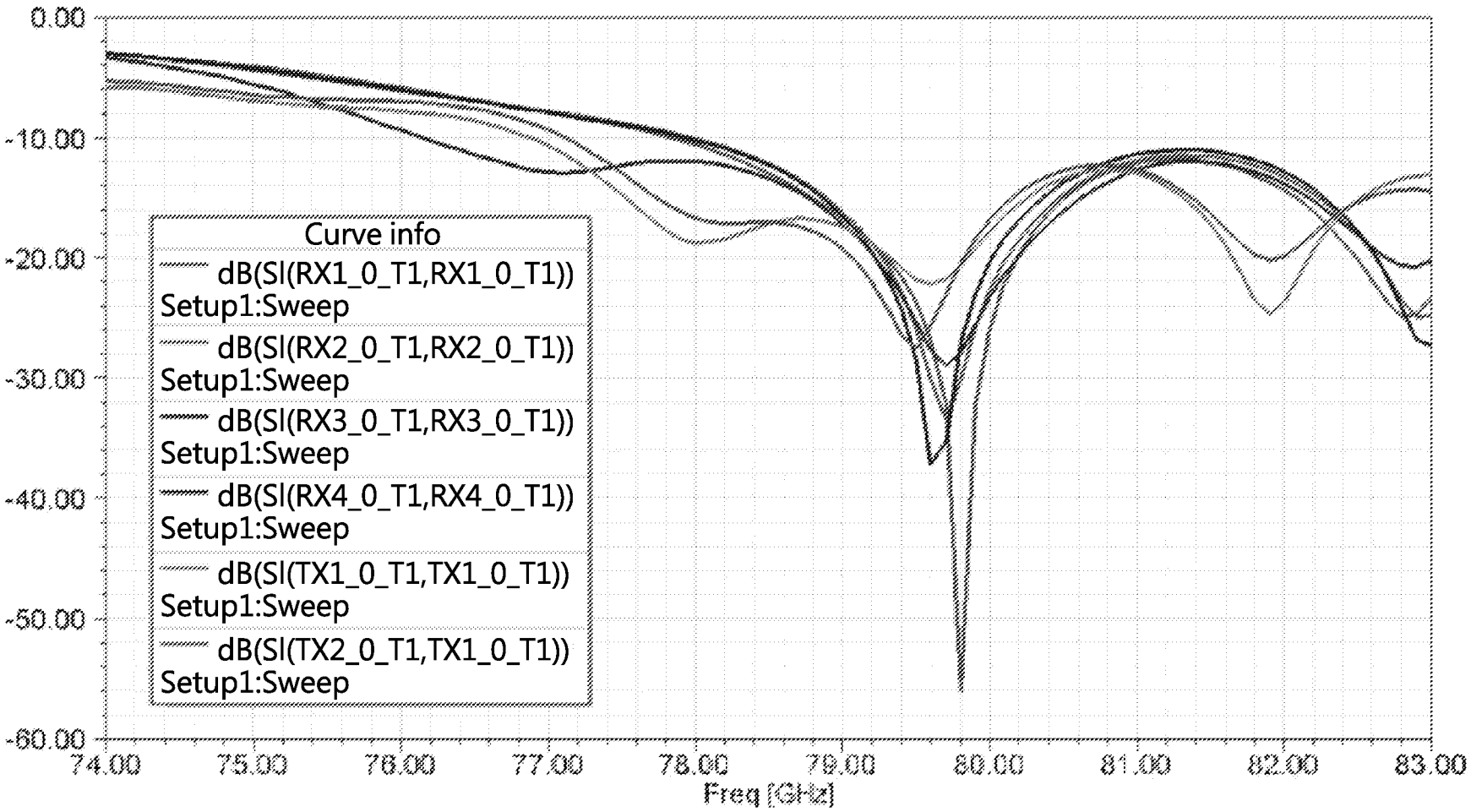
FIG. 5 is the Return Loss diagram of TI-AWR1642 reference board.
Figure 6:
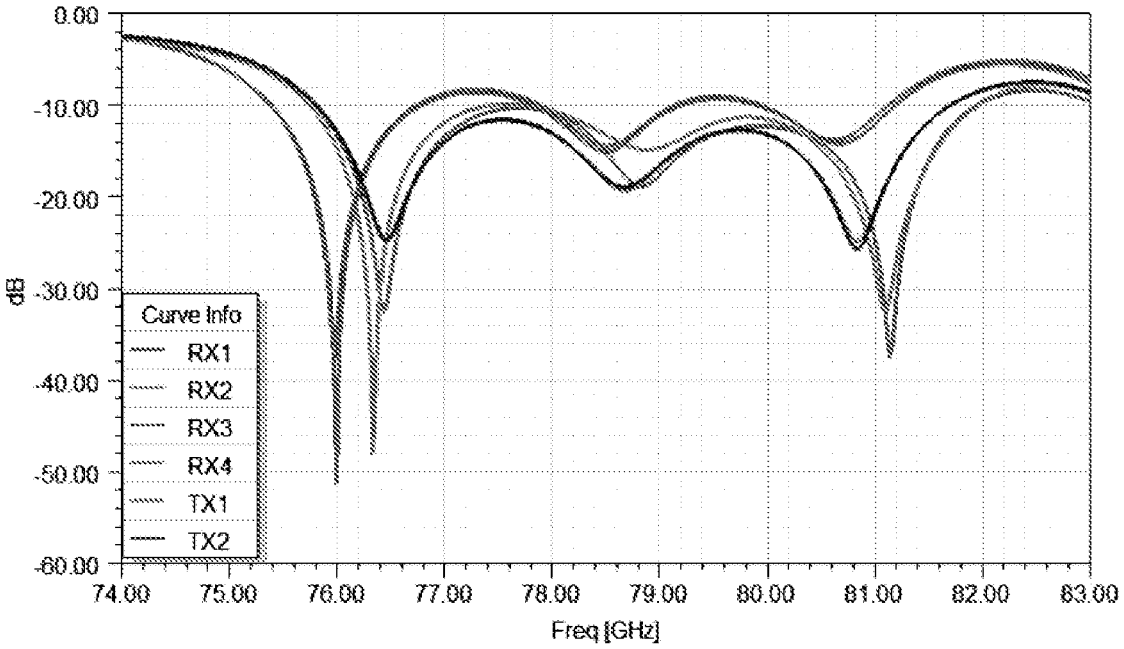
FIG. 6 is the Return Loss diagram of the array antenna of an embodiment according to the present invention.

FIG. 5 shows a Return Loss of a TI-AWR1642 reference board and FIG. 6 shows a Return Loss of the array antenna 10 according to the present invention. Simulation results show that the antenna gain of the array antenna 10 according to the present invention is better than that of the TI-AWR1642 reference board by 3 dB. A single patch array antenna according to present invention may be applied to circuit designs recommended by control unit manufacturers.

Figure 8:
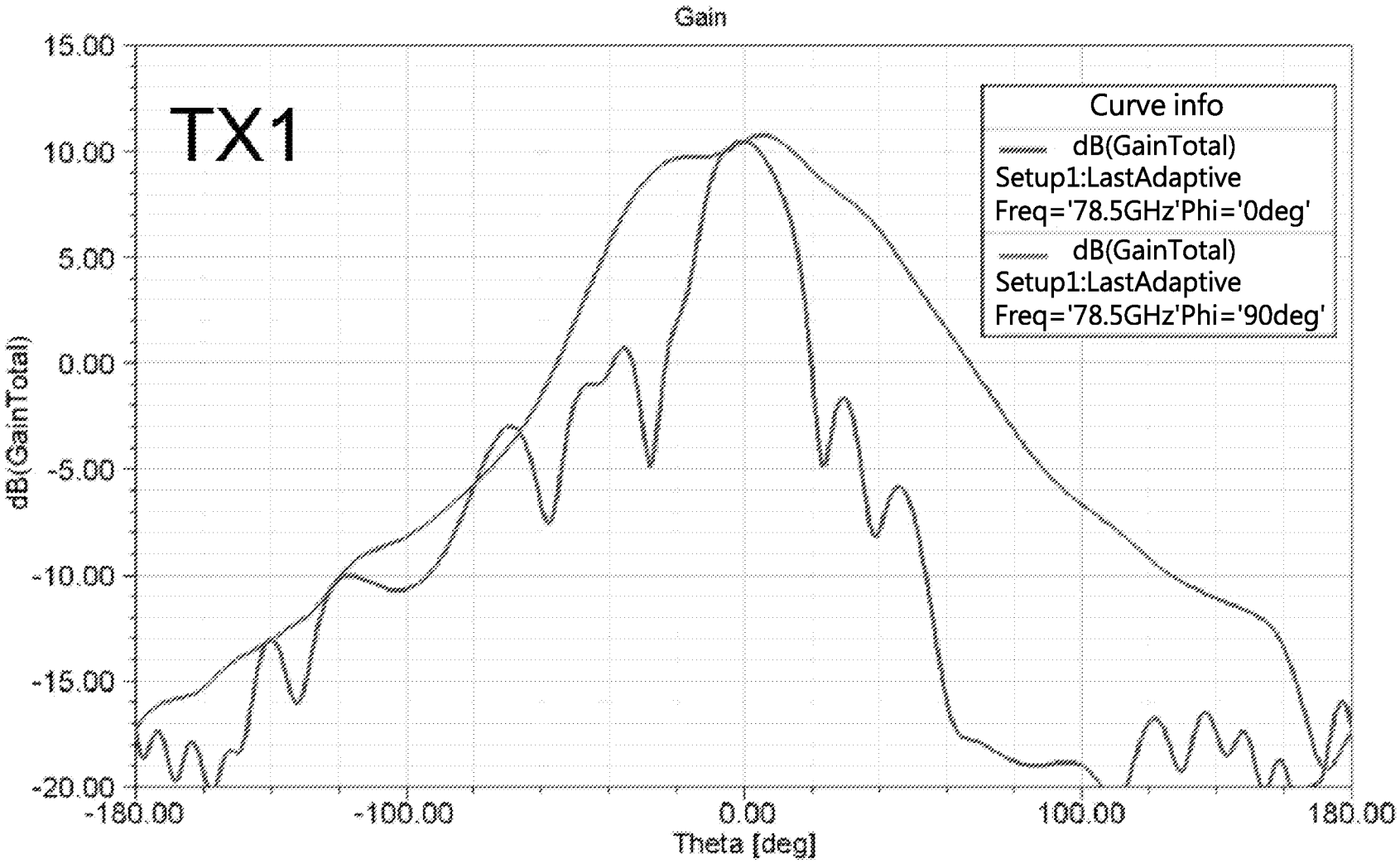
FIG. 8 is the TX1 Gain diagram of TI-AWR1642 reference board.
Figure 9:
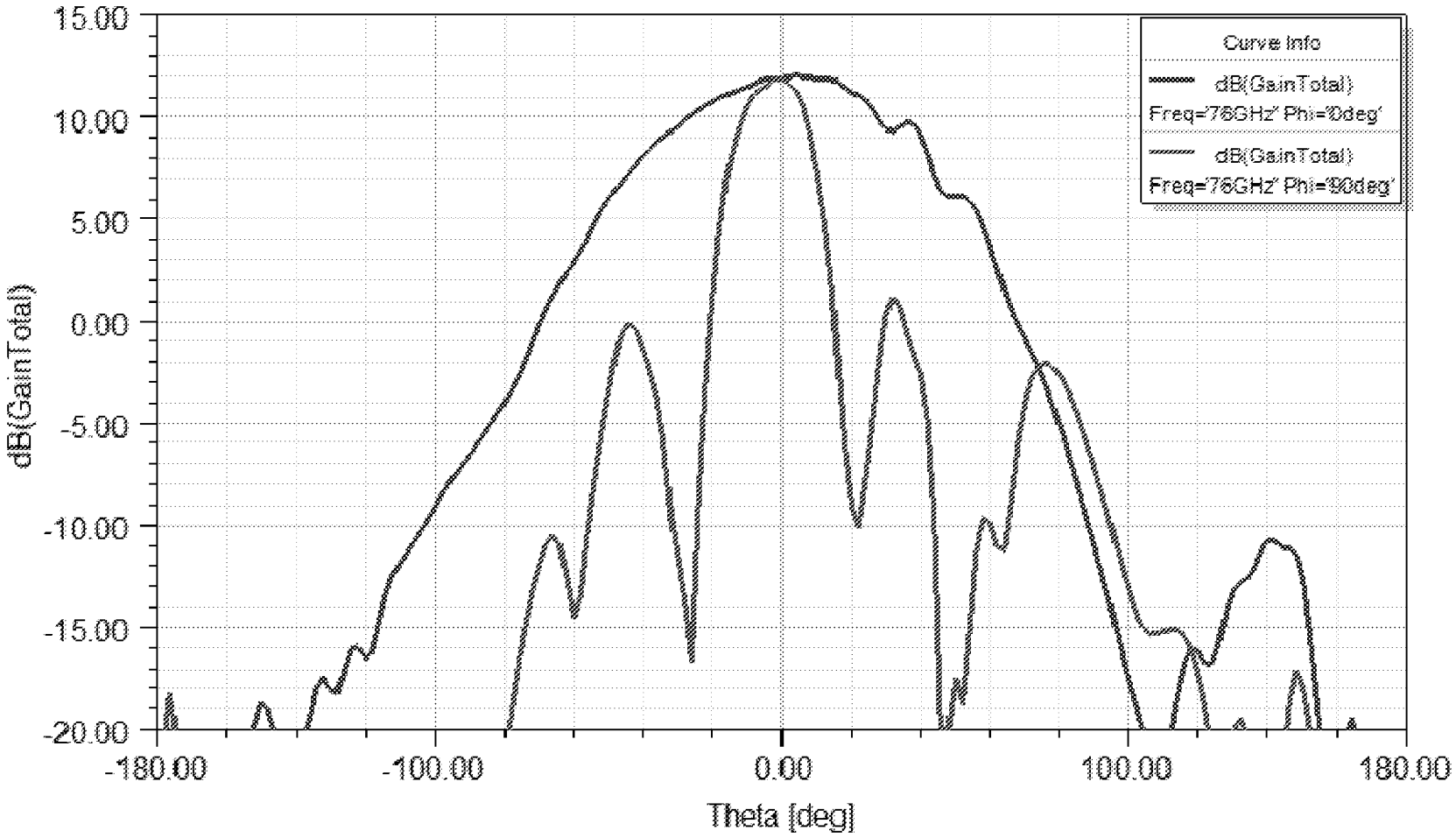
FIG. 9 is the TX1 Gain diagram of an array antenna according to the present invention.

FIG. 8 shows a TX1 Gain of the TI-AWR1642 reference board and FIG. 9 shows a TX1 Gain of the array antenna 10 according to the present invention. Simulation results indicate the gain of the array antenna according to the present invention is increased by 1 dB compared with the reference board architecture. Therefore, it is suggested that a 77 GHz millimeter-wave radar to incorporate the LCP substrate 10, an patch array antenna, and concave slots 5 in the foremost patch antenna 4 to effectively improve the working bandwidth and increase the antenna gain.

In this embodiment, the distance between a main body of the array antenna 10 using LCP material and a grounding in a lower layer is 100 μm, and this array antenna 10 is applicable to an mmWave automotive array radar which operating frequency is from 76 GHz to 81 GHz.

In other embodiments, the distance between a main body of the array antenna using LCP material and a grounding in a lower layer ground may be from 80 to 120 μm, and this array antenna 10 is applicable to an mmWave automotive array radar which operating frequency is from 76 GHz to 81 GHz. Although the distance between the main body and a grounding in a lower layer may be in the range of 80 μm to 120 μm, the optimal distance is 100 μm for the frequency of 77 GHz.

In this embodiment, the radiation electromagnetic field of the array antenna is the sum (vector sum) of radiation fields of units included in the array antenna. Locations of the units and an amplitude and a phase of a feeding current may be all individually adjusted.

In this embodiment, a patch array antenna is formed by connecting four patch antennas 4 in series. A concave slot 5 in the foremost patch antenna 4 effectively improves impedance matching to improve the bandwidth of the array antenna, and may increase the radiation gain of the antenna by 6 dB. However, the patch array antenna is not limited to four patch antennas 4. In other embodiments, the patch array antenna may alternatively be formed by connecting a different quantity of patch antennas in series, such as 1, 2, 3, 5, 6, 7, 8, 9, or 10, to achieve a different gain effects. For example, when eight patch antennas 4 are connected in series, a gain effect may reach 9 dB. Although a larger quantity of patch antennas connected in series indicates a higher gain, the quantity of patch antennas connected in series is limited by the appearance and space of the product design. Moreover, a larger quantity of patch antennas connected in series also indicates a more complicated fine tuning between gain effect in the array and impedance matching.

Figure 10:
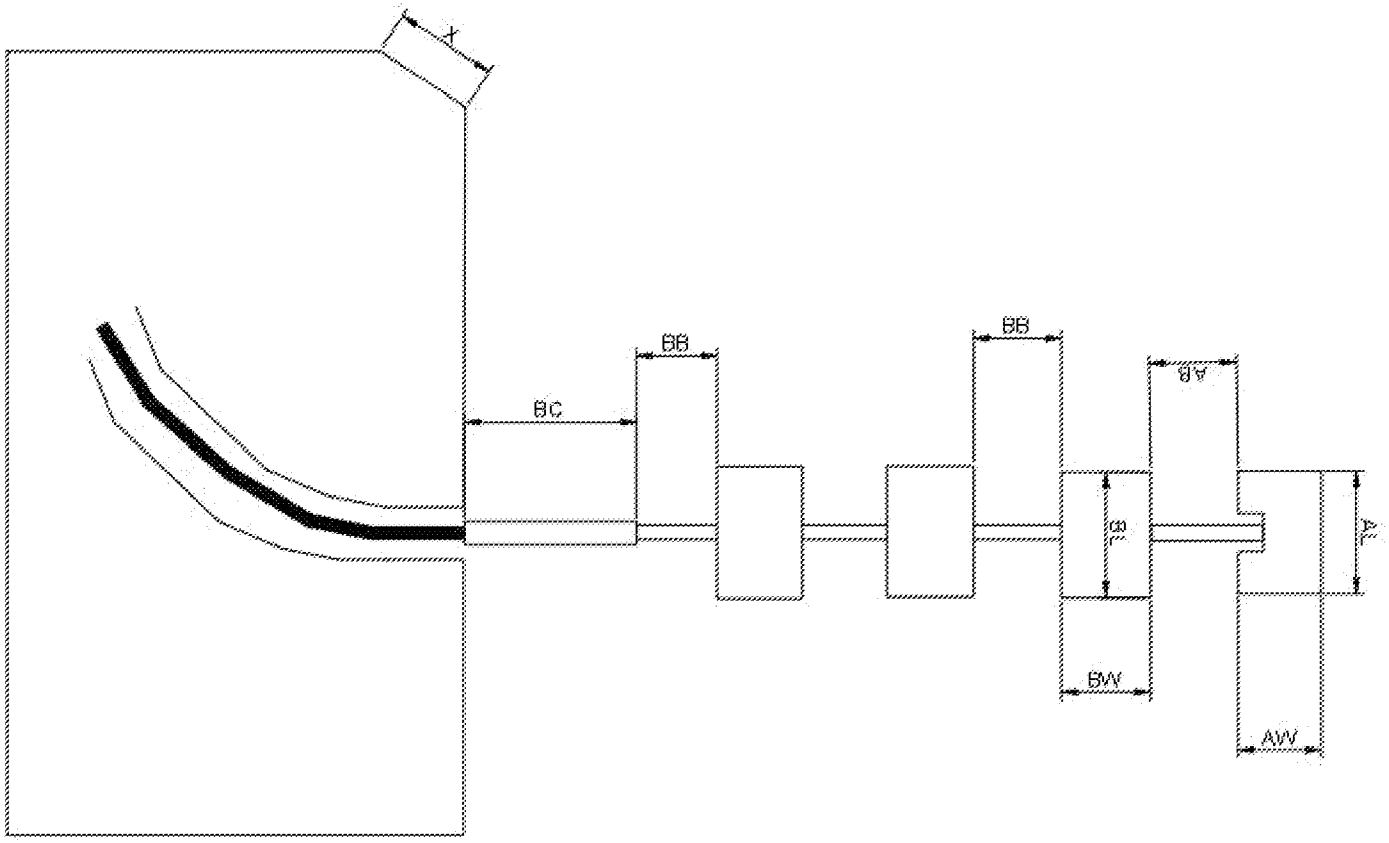
FIG. 10 is the dimension diagram of a single patch array antenna according to the present invention.

Sizes of array antennas are shown in Table 1, and a schematic diagram of a size of an antenna is shown in FIG. 10.

| Position | AL | AW | BL | BW | AB | BB |
|---|---|---|---|---|---|---|
| Nominal | 1.6 mm | 1.04 mm | 1.6 mm | 1.08 mm | 1.24 mm | 1.24 mm |

| Position | AL1 | AW1 | BB | BC | X |
|---|---|---|---|---|---|
| Nominal | 0.28 mm | 0.26 mm | 1.22 mm | 0.75 mm | 3.25 mm |

Figure 11:
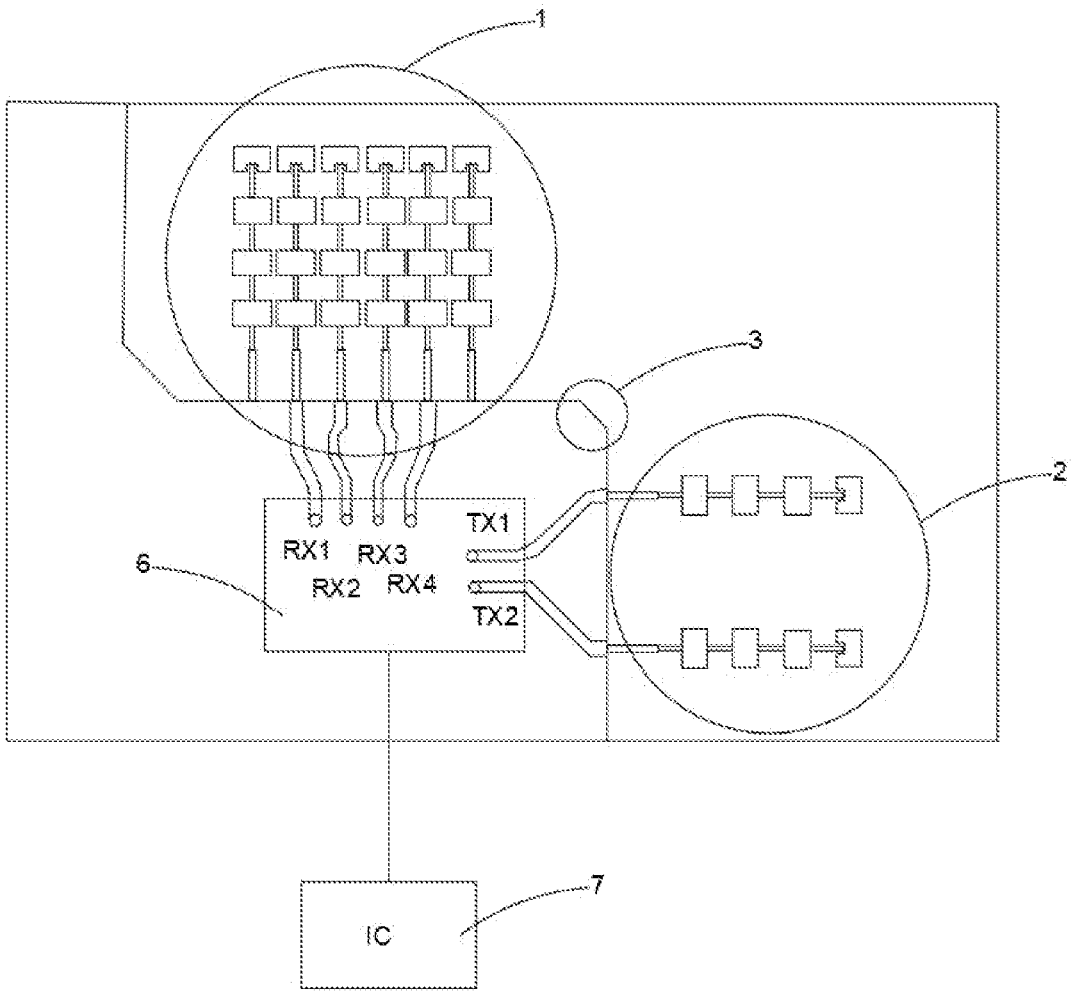
FIG. 11 is the diagram of an array antenna with a control unit according to the present invention.

A control unit 7 (for example, the foregoing IC) is disposed on the LCP substrate, to connect to patch array antennas of the transmitting end and the receiving end. In this embodiment, as shown in FIG. 11, the control unit 7 (for example, the foregoing IC) may be changed from being placed on the front side of the LCP substrate 10 to the back side of the LCP substrate 10. A via 6 or bonding wire is used to connect the control unit 7 to the signal transmission and receiving of the array antenna 10.

The transmission loss of a usual PCB substrate at a high frequency is excessively high. The most common 77 GHz PCB substrate in the market currently is Rogers RO4835, but an array antenna 10 may encounter various severe environment challenges. For example, automobiles in different weather conditions. The moisture absorption rate of the LCP substrate of the present invention is 0.03%, which is lower as compared with 0.05% of Rogers RO4835, thereby ensuring that material characteristics of the LCP substrate in different environments are still stable.

To conclude, the present invention provides an array antenna of a 77 GHz radar on the LCP substrate. Compared with the existing Texas Instruments (TI) AWR1642 reference board design, the array antenna according to the present invention is proven to have a larger antenna gain −10 dB, to increase the bandwidth ratio from 3.8% to 6.3%, and thereby to improve the antenna impedance matching and the working bandwidth.

The foregoing embodiments are merely used for describing the technical solutions of the present invention, but are not intended to limit the scope of the invention. It should be understood by a person of ordinary skill in the art that although this specification has been described in detail with reference to the foregoing embodiments, modifications can be made to the technical solutions described in the foregoing embodiments, or equivalent replacements can be made to some technical features in the technical solutions. Modifications or replacements will not cause the essence of corresponding technical solutions to depart from the spirit and scope of the technical solutions in the embodiments of this application.

What is claimed is:

1. An array antenna, comprising:

a liquid crystal polymer (LCP) substrate, with antenna transceiver circuits disposed thereon; and a plurality of patch array antennas, disposed on the LCP substrate and connected to the antenna transceiver circuits, wherein each patch array antenna comprises a plurality of patch antennas connected in series, and the foremost patch antenna of each of the patch array antennas has at least one concave slot on a radiating surface by each side of respective feed line;

wherein the LCP substrate includes a first bonding region and a second bonding region, the first bonding region is configured to an antenna transmitting end of the antenna transceiver circuit, and the second bonding region is configured to an antenna receiving end of the antenna transceiver circuit; and wherein the junction of the first bonding region and the second bonding region includes at least a truncated corner.

2. The array antenna of claim 1, wherein one or more of the remaining patch antennas of each of the patch array antennas also have a concave slot on the radiating surface by each side of respective feed line.

3. The array antenna of claim 2, wherein the length of the concave slot on the radiating surface of the patch antenna is between 0.28 mm and 0.33 mm.

4. The array antenna of claim 1, wherein the length of the concave slot on the radiating surface of the patch antenna is between 0.28 mm and 0.33 mm.

5. The array antenna of claim 1, wherein the length of the concave slot on the radiating surface of the patch antenna is about L/3, wherein L is the length of the patch antenna in the feed line direction.

6. The array antenna of claim 1, wherein a control unit is disposed on the LCP substrate and connected to the antenna transmitting end and the antenna receiving end of the antenna transceiver circuit.

7. The array antenna of claim 6, wherein the control unit is connected to the patch array antennas by via and/or bonding wire when being disposed on the back side of the LCP substrate.

8. The array antenna of claim 1, wherein directions of the patch array antennas at the antenna transmitting end and the antenna receiving end are substantially perpendicular to each other.

9. The array antenna of claim 1, wherein the length of the truncated corner outline is 1.5λg, wherein λg is the wavelength of the corresponding frequency.

10. The array antenna claim 1, wherein the distance between a main body of the patch array antenna and a grounding in a lower layer is 80 μm-120 μm.

11. The array antenna of claim 1, wherein the patch array antenna includes patch antennas connected in series, and is connected through via on the LCP substrate.

12. The array antenna of claim 11, wherein the quantity of patch antennas in a single string of patch array antenna is from 2 to 10.

13. The array antenna of claim 11, wherein the center impedance of the foremost patch antenna is between 0Ω and 50Ω.

14. The array antenna of claim 11, wherein the edge impedance of the foremost patch antenna is between 298Ω and 322Ω.

* * * * *